US006418576B1

(12) United States Patent
Starkweather

(10) Patent No.: US 6,418,576 B1
(45) Date of Patent: Jul. 16, 2002

(54) ROPE HAMMOCK

(75) Inventor: John Vincent Starkweather, Lanark (CA)

(73) Assignee: 1381722 Ontario Ltd., Lanark (CA)

( * ) Notice: Subject to any disclaimer, the term of this patent is extended or adjusted under 35 U.S.C. 154(b) by 0 days.

(21) Appl. No.: 09/759,441

(22) Filed: Jan. 16, 2001

(51) Int. Cl.[7] ..... A45F 3/22
(52) U.S. Cl. ..... 5/123
(58) Field of Search ..... 5/123, 120, 122

(56) References Cited

U.S. PATENT DOCUMENTS 329,631 A * 11/1885 Dillman ..... 5/120

FOREIGN PATENT DOCUMENTS

CA 1296142 * 2/1992 ..... 5/123

* cited by examiner

*Primary Examiner*—Alexander Grosz
(74) *Attorney, Agent, or Firm*—Richard J. Hicks

(57) ABSTRACT

A rope hammock, having a woven rope bed, a harness at each end of the bed and a stretcher at each end is described. The harness ropes are passed through respective holes in the stretcher and around loops at the ends of the bed. The harness ropes are then drawn back through the same holes and the free ends of the harness ropes are provided with stoppers to prevent them from pulling back through the holes when the hammock is in use.

5 Claims, 3 Drawing Sheets

ROPE HAMMOCK

FIELD OF INVENTION

This invention relates to rope hammocks and in particular to an improved method for knotting the ropes thereof and to an improved rope hammock product.

BACKGROUND OF INVENTION AND PRIOR ART

Rope hammocks of the "Carolina style" have been known for well over a hundred years and include a woven rope bed, usually fabricated with a braided cord, attached to a spray of harness ropes at each end thereof which converge to a mounting ring which in turn can be mounted on a hook or other support device. The harness ropes at each end are held apart by means of a spreader bar, sometimes also referred to as a stretcher. The spreaders are provided with a plurality of holes through which the harness ropes pass. The harness ropes are tied to the hammock bed by means of a knot on the bed side of the spreader. This arrangement permits the harness ropes in the centre portion of the harness to elongate or stretch more than those close to the sides of the bed because the greater portion of the weight is taken by the central ropes when the hammock is in use. However, with use the stretcher may slide up and down the harness ropes and consequently cause wear. This wear problem was addressed in my earlier Canadian Patent 1,296,142 issued Feb. 25, 1992, by providing a plurality of harness ropes each one of which passes through a respective hole in the spreader, loops around at least a pair of adjacent ropes in the bed, and passes back through the same hole in the spreader and pulled tight to force the loop, and the bed ropes around which it is looped, against the spreader. The free end of the harness rope is then secured to the standing part of the harness rope with a knot, commonly a bowline knot, on the harness side of the spreader. This arrangement substantially eliminates sliding of the spreader on the harness ropes and considerably reduces wear. Tying the bowlines is, however, time consuming and it is difficult to accurately locate the individual knots to achieve uniformity of the harness ropes and to hold the spreader tightly. Once tied, although a bowline does not overtighten with an increased load, as it has an unchanging loop, nevertheless it can be difficult to untie should repair of the hammock be required.

OBJECT OF INVENTION

It is, therefore, an object of the present invention to provide an improved method for securing the harness ropes to the bed ropes while holding the spreader bar tightly to reduce wear.

It is another object of the present invention to provide an improved hammock in which the tightness of the spreader bar is controlled and in which knots can be untied easily to facilitate repair.

BRIEF STATEMENT OF INVENTION

By one aspect of this invention there is provided in a woven rope hammock, comprising a bed of woven ropes having at each end a plurality of end loops arranged as a plurality of sets, each set comprising one of a single loop, a pair of end loops and three end loops; a harness for each end of said bed, each harness having a harness rope for each set of said plurality of sets at each end of said bed, and a stretcher for each said harness, each stretcher having a plurality of holes therethrough spaced along its length, there being one hole for each harness rope in the respective harness, and wherein a free end of each said harness rope passes through a respective hole in a respective stretcher, passes through a respective set of end loops and is returned through the said respective hole, the improvement wherein said free end of each said harness rope is provided with stopper means to prevent said free end from passing through said respective hole after assembly.

By another aspect of this invention there is provided in a method of making a woven rope hammock comprising a bed, a stretcher at each end of the bed, a harness of ropes at each end of the bed, and a harness ring for each end, comprising the steps of weaving a bed of ropes and forming at the ends of the bed a plurality of end loops, arranging the end loops in a plurality of sets, each set comprising one of a single end loop, a pair of adjacent end loops and three adjacent end loops; forming a harness of ropes for each end of said bed, said harness being formed with one rope for each set at the respective end; providing a stretcher for each end of said bed, each with one hole in a plurality of spaced holes for each harness rope in the respective end; securing one end of each harness rope in a respective harness to a respective harness ring; passing a second end of each harness rope through a respective hole in a respective stretcher; passing each said second end of each harness rope through a respective one of said sets of end loops; drawing the second end of each harness rope back through the same respective hole in said stretcher; pulling each harness rope taut so as to draw the respective set against the stretcher; the improvement comprising providing stopper means at the second end of each said stopper rope, after assembly of said hammock, so as to prevent passage of said free end through said respective hole in said stretcher.

DETAILED DESCRIPTION OF PREFERRED EMBODIMENTS

Figure 1:
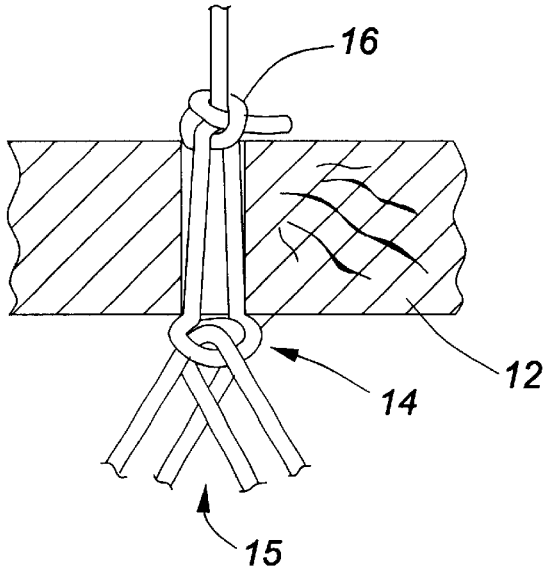
PRIOR ART FIG. 1
FIG. 1 is a partial plan view showing one end of a hammock bed and harness according to my prior patent.
Figure 2:
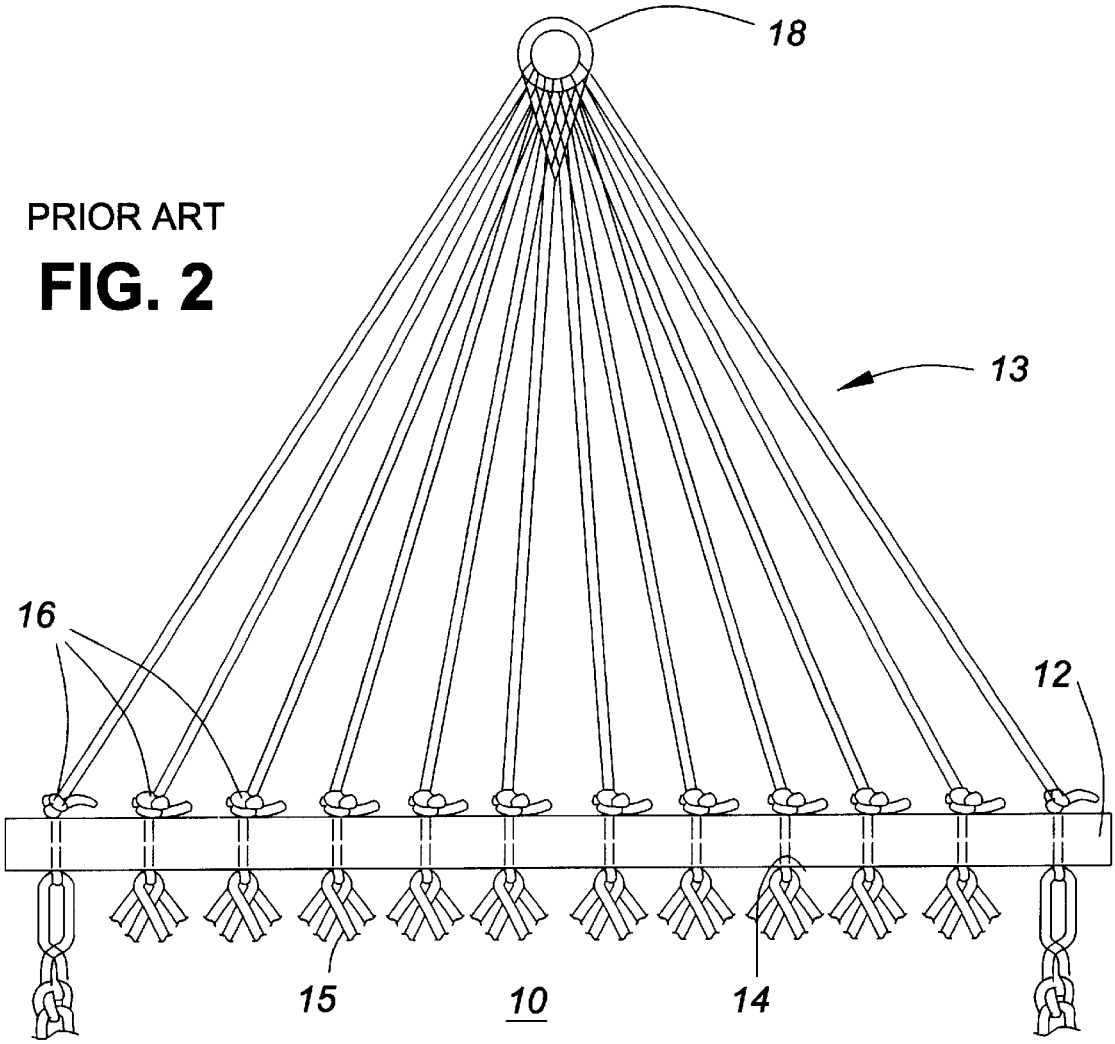
PRIOR ART FIG. 2
FIG. 2 is an enlarged view of a single hole and single harness rope in the embodiment of the prior art shown in FIG. 1, when the knot has been pulled tight.
Figure 3:
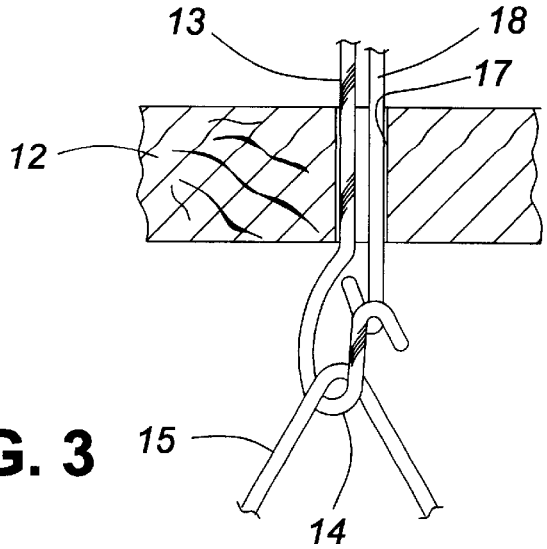
FIG. 3 is an enlarged view, similar to FIG. 2, showing the method of manufacture.

Referring to FIG. 1, there is shown a partial view of part of a hammock according to my prior invention, in which a hammock having a bed 10 formed with ropes 15, is provided with a spreader bar 12 through which a plurality of harness ropes 13 are threaded. Ropes 13 are passed through a loop 14 at the confluence of each bundle of bed ropes 15 and back through the same hole in spreader 12. The free end of each rope 13 is then tied to the standing part thereof with a knot 16, preferably but not essentially a bowline, as seen more clearly in FIG. 2. It will be appreciated that passing the rope 13 back through the hole 17 in spreader bar 12 may be facilitated by use of a hook 19 which may be inserted through hole 17, as seen in FIG. 3. The other end of ropes 13 converge and are secured to a ring 19.

Figure 4:
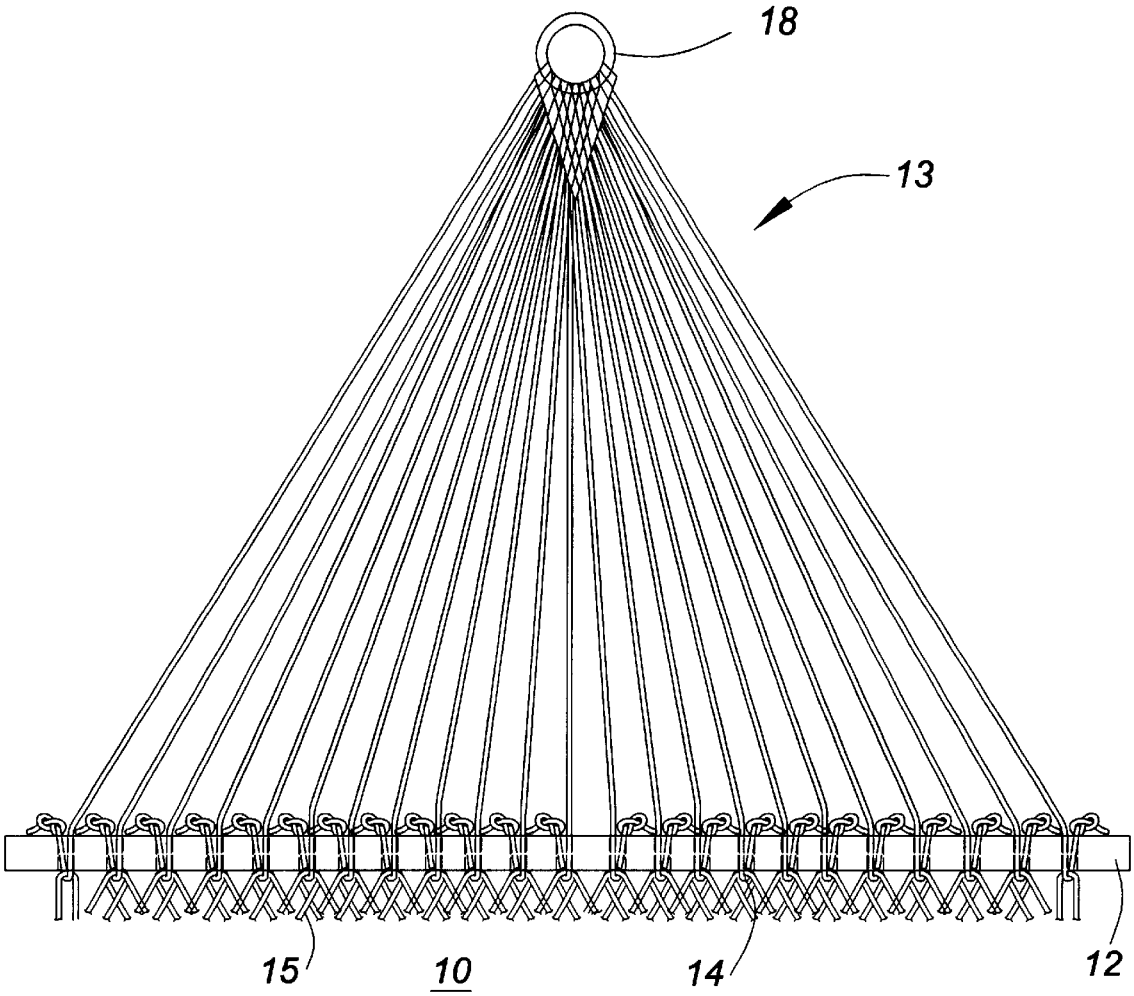
FIG. 4 is a partial plan view showing one end of a hammock bed and harness according to the present invention.
Figure 5:
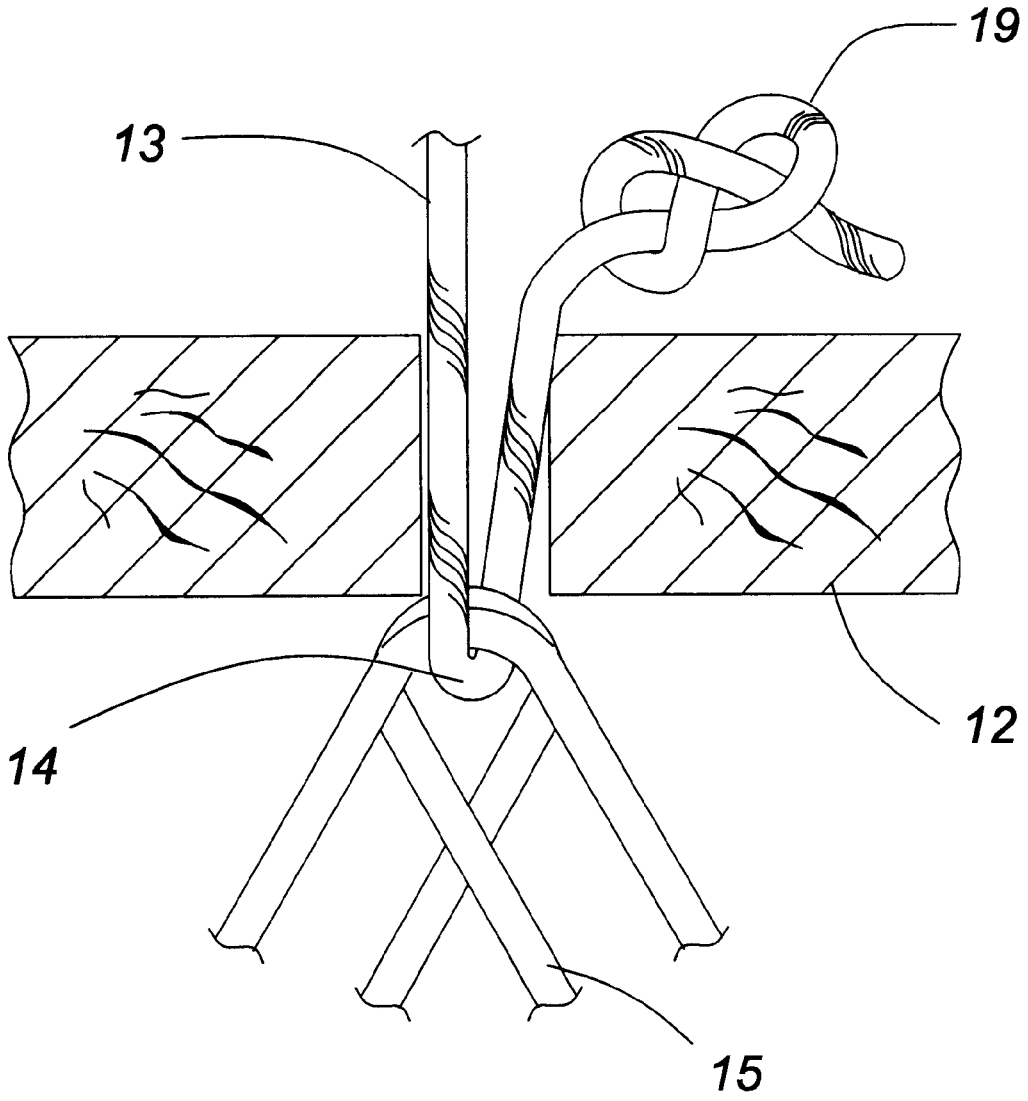
FIG. 5 is an enlarged view, similar to FIG. 2, showing the knot before it is pulled tight, according to the present invention.

FIG. 4 shows one end of a hammock according to the present invention and the parts thereof are accorded the same reference numerals as used in FIGS. 1–3 hereinabove to designate identical parts. However, when rope 13 is drawn back through hole 17 with hook 18, as shown in FIG. 3, the free end is not secured to the standing part of rope 13, as seen in FIG. 2, but is rather tied to itself with a stopper knot 19, such as a figure-of-eight knot or other stopper knot well known to those skilled in the art, such as a thumb knot or monkey's fist. In a less preferred embodiment, as it may be less aesthetically pleasing, the knot 19 may be dispensed with entirely and the end of rope 13 may be stopped with a wooden or metal peg or by means of a deformable metal ring clamped and flattened therearound, in a manner well known to those skilled in the art.

I claim:

1. In a woven rope hammock, comprising a bed of woven ropes having at each end a plurality of end loops arranged as a plurality of sets, each set comprising one of a single loop, a pair of end loops and three end loops; a harness for each end of said bed, each harness having a harness rope for each set of said plurality of sets at each end of said bed, and a stretcher for each said harness, each stretcher having a plurality of holes therethrough spaced along its length, there being one hole for each harness rope in the respective harness, and wherein a free end of each said harness rope passes through a respective hole in a respective stretcher, passes through a respective set of end loops and is returned through the said respective hole, the improvement wherein said free end of each said harness rope is not tied to itself and is provided with a stopper knot adjacent the free end so as to prevent said free end from passing through said respective hole after assembly.

2. A woven rope hammock as claimed in claim 1 wherein said stopper knot is provided snugly adjacent said stretcher.

3. A woven rope hammock as claimed in claim 2 wherein said stopper knot is a figure-of-eight knot.

4. In a method of making a woven rope hammock comprising a bed, a stretcher at each end of the bed, a harness of ropes at each end of the bed, and a harness ring for each end, comprising the steps of weaving a bed of ropes and forming at the ends of the bed a plurality of end loops, arranging the end loops in a plurality of sets, each set comprising one of a single end loop, a pair of adjacent end loops and three adjacent end loops; forming a harness of ropes for each end of said bed, said harness being formed with one rope for each set at the respective end; providing a stretcher for each end of said bed, each with one hole in a plurality of spaced holes for each harness rope in the respective end; securing one end of each harness rope in a respective harness to a respective harness ring; passing a second end of each harness rope through a respective hole in a respective stretcher; passing each said second end of each harness rope through a respective one of said sets of end loops; drawing the second end of each harness rope back through the same respective hole in said stretcher; pulling each harness rope taut so as to draw the respective set against the stretcher; the improvement wherein said second end of each harness rope is not tied to said harness rope but is provided with a stopper knot adjacent the free end, after assembly of said hammock, so as to prevent passage of said free end through said respective hole in said stretcher.

5. A method as claimed in claim 4 wherein said tying step comprises tying a figure-of-eight knot.

* * * * *